US008867089B2

(12) United States Patent
Uehara et al.

(10) Patent No.: US 8,867,089 B2
(45) Date of Patent: Oct. 21, 2014

(54) RECORDING MATERIAL TRANSPORTING DEVICE AND IMAGE FORMING APPARATUS

(75) Inventors: Makio Uehara, Kanagawa (JP); Michio Tada, Kanagawa (JP); Takashi Abe, Kanagawa (JP); Yoshiyuki Takaishi, Kanagawa (JP); Yousuke Hasegawa, Tokyo (JP); Yoichi Yamakawa, Kanagawa (JP); Hisakazu Onoe, Kanagawa (JP); Yasunobu Gotoh, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 223 days.

(21) Appl. No.: 13/297,830

(22) Filed: Nov. 16, 2011

(65) Prior Publication Data

US 2012/0300261 A1 Nov. 29, 2012

(30) Foreign Application Priority Data

May 25, 2011 (JP) ..... 2011-117191

(51) Int. Cl.
*G06K 15/00* (2006.01)
*B65H 9/00* (2006.01)

(52) U.S. Cl.
CPC ..... *B65H 9/002* (2013.01); *B65H 2404/133* (2013.01); *B65H 2404/143* (2013.01); *B65H 2404/1442* (2013.01); *B65H 2511/12* (2013.01); *B65H 2801/06* (2013.01)
USPC ..... 358/1.18; 358/296; 358/448; 358/488; 358/498

(58) Field of Classification Search
USPC ..... 358/448, 488, 498, 296
See application file for complete search history.

(56) References Cited

U.S. PATENT DOCUMENTS

| | | | | |
|---|---|---|---|---|
| 5,039,086 | A | 8/1991 | Matsuno et al. | |
| 5,374,053 | A | 12/1994 | Doucet et al. | |
| 2008/0230986 | A1 * | 9/2008 | Tada et al. | 271/248 |
| 2009/0250869 | A1 | 10/2009 | Muller et al. | |
| 2010/0109226 | A1 * | 5/2010 | Kitazawa et al. | 271/3.14 |

FOREIGN PATENT DOCUMENTS

| | | |
|---|---|---|
| JP | A-2-70639 | 3/1990 |
| JP | A-7-215545 | 8/1995 |
| JP | A-2006-256803 | 9/2006 |
| JP | A-2009-221021 | 10/2009 |

* cited by examiner

*Primary Examiner* — Paul F Payer
*Assistant Examiner* — Marcellus Augustin
(74) *Attorney, Agent, or Firm* — Oliff PLC

(57) ABSTRACT

A recording material transporting device includes a transport path along which a recording material is transported, a first transporting unit that includes a first rotating member and a second rotating member being arranged apart from each other in a direction crossing the transport path, the first transporting unit correcting skew of the recording material by rotating the first rotating member and the second rotating member in a different speed, and a second transporting unit that includes a third rotating member and a fourth rotating member being arranged apart from each other in the crossing direction, the second transporting unit correcting skew of the recording material by rotating the third rotating member and the fourth rotating member in a different speed, wherein the third rotating member and the fourth rotating member are arranged between the first rotating member and the second rotating member.

13 Claims, 7 Drawing Sheets

RECORDING MATERIAL TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2011-117191 filed May 25, 2011.

BACKGROUND

Technical Field

The present invention relates to a recording material transporting device and an image forming apparatus.

SUMMARY

According to an aspect of the invention, there is provided a recording material transporting device including:

a transport path along which a recording material is transported;

a first transporting unit that includes a first rotating member and a second rotating member being arranged apart from each other in a direction crossing the transport path, the first transporting unit correcting skew of the recording material by rotating the first rotating member and the second rotating member in a different speed; and a second transporting unit that includes a third rotating member and a fourth rotating member being arranged apart from each other in the crossing direction, the second transporting unit correcting skew of the recording material by rotating the third rotating member and the fourth rotating member in a different speed, wherein the third rotating member and the fourth rotating member are arranged between the first rotating member and the second rotating member.

BRIEF DESCRIPTION OF THE DRAWINGS

Exemplary embodiments of the present invention will be described in detail based on the following figures, wherein.

DETAILED DESCRIPTION

The details of an embodiment of the invention will be described in detail below with reference to accompanying drawings.

Figure 1:
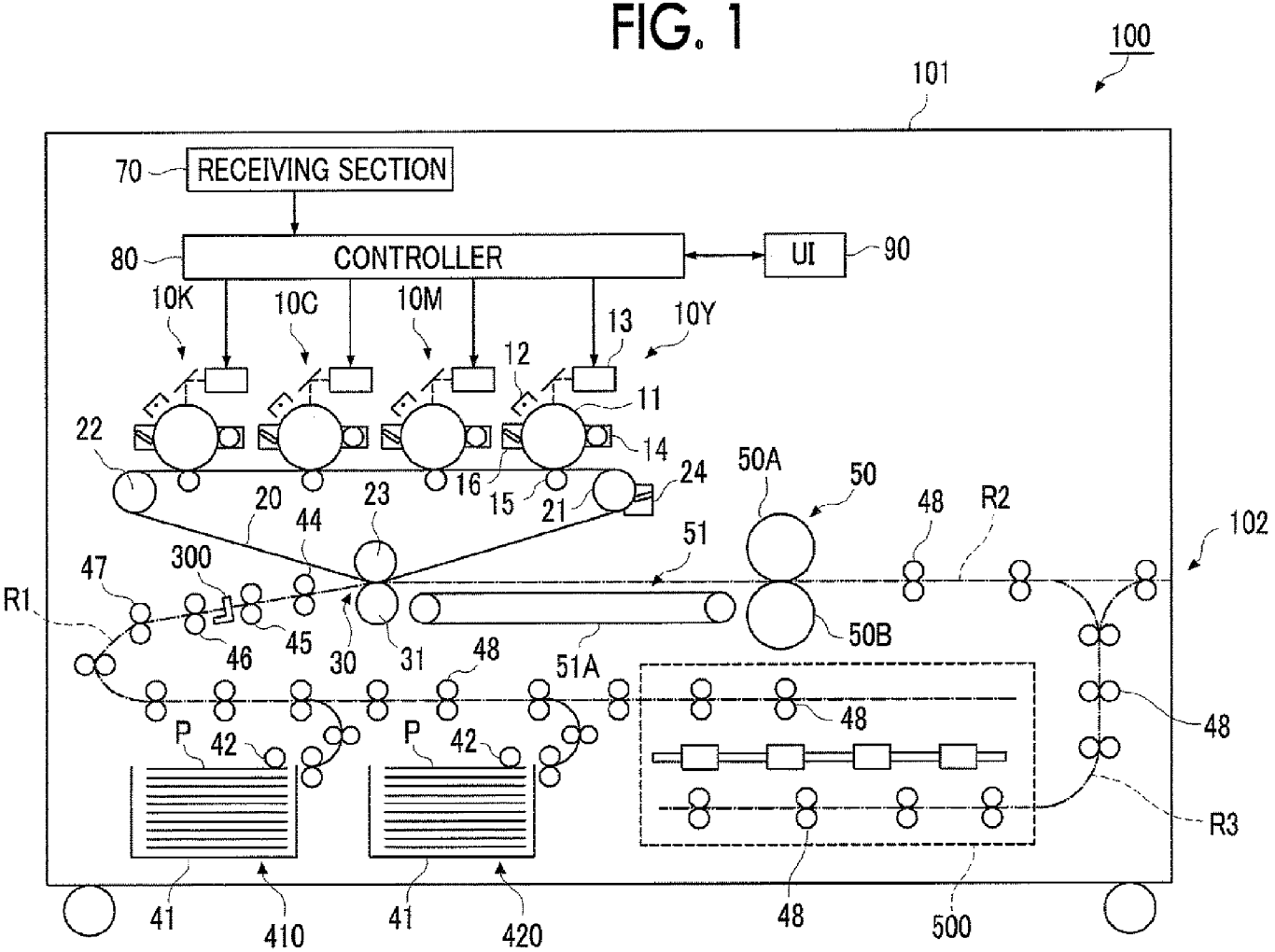
FIG. 1 is a view showing an image forming apparatus as seen from the front side.

FIG. 1 is a view showing an image forming apparatus to which this embodiment is applied as seen from the front side. An image forming apparatus 100 shown in FIG. 1 has a so-called tandem-type configuration, and includes plural image forming units 10 (10Y, 10M, 10C, and 10K) that form toner images having respective color components by an electrophotographic system. Further, the image forming apparatus 100 according to this embodiment includes a controller 80 that includes a CPU (Central Processing Unit), a ROM (Read Only Memory), and the like and controls the operations of respective devices and sections of the image forming apparatus 100.

Furthermore, the image forming apparatus 100 includes a user interface section (UI) 90. The user interface section (UI) 90 is formed of a display panel; outputs an instruction, which is received from a user, to the controller 80; and displays information, which is received from the controller 80, to a user. In addition, the image forming apparatus includes a receiving section 70 that receives image data and the like from, for example, a personal computer (PC), an image reading device (scanner), and the like. Further, the image forming apparatus 100 includes an intermediate transfer belt 20 and a secondary transfer device 30. The toner images, which have the respective color components and are formed by the respective image forming units 10, are sequentially transferred (primarily transferred) to the intermediate transfer belt 20, and the intermediate transfer belt 20 holds the toner images. The secondary transfer device 30 collectively transfers (secondarily transfers) the toner images, which are held on the intermediate transfer belt 20, to a sheet P that is an example of a recording material.

Further, a first sheet transport path R1 along which a sheet P is transported toward the secondary transfer device 30 passes and a second sheet transport path R2 along which the sheet P having passed through the secondary transfer device 30 passes are formed in the image forming apparatus 100. Furthermore, a third sheet transport path R3 is formed on the downstream side of a fixing device 50 (to be described below). The third sheet transport path R3 is branched from the second sheet transport path R2 and extends to the position below the first sheet transport path R1. A part of the third sheet transport path R3 is parallel to the first sheet transport path R1.

Moreover, an inverting mechanism 500, which transports a sheet P to the first sheet transport path R1 from the third sheet transport path R3, inverts the sheet P, and feeds the sheet P to the first sheet transport path R1, is provided in this embodiment. In other words, an inverting mechanism 500, which inverts a sheet P about an axis along a sheet transport direction of the first sheet transport path R1 and a sheet transport direction of the third sheet transport path R3, is provided in this embodiment.

In addition, in this embodiment, an opening 102 is formed at a housing 101 of the image forming apparatus 100. Here, the sheet P transported along the second sheet transport path R2 is discharged to the outside of the housing 101 through the opening 102 and is stacked on a sheet stacking section (not shown). Meanwhile, a processing device (not shown) may be provided adjacent to the housing 101, and processing such as punching may be further performed at the sheet P discharged from the opening 102. Further, the image forming apparatus 100 includes a first sheet feeding device 410 that feeds a sheet P to the first sheet transport path R1. Furthermore, the image forming apparatus includes a second sheet feeding device 420 that is provided on the upstream side of the first sheet feeding device 410 in the transport direction of a sheet P and feeds a sheet P to the first sheet transport path R1.

Meanwhile, the first and second sheet feeding devices 410 and 420 have the same configuration. Each of the first and second sheet feeding devices 410 and 420 includes a sheet storage section 41 that stores sheets P and a take-out roll 42 that takes out and transports the sheet P stored in the sheet storage section 41. Further, first transport rolls 44, which transport a sheet P positioned on the first sheet transport path R1 toward the secondary transfer device 30, is provided on the first sheet transport path R1 on the upstream side of the secondary transfer device 30. Furthermore, second transport rolls 45 that transport a sheet P toward the first transport rolls 44, third transport rolls 46 that transport a sheet P toward the second transport rolls 45, and fourth transport rolls 47 that transport a sheet P toward the third transport rolls 46 are provided on the first sheet transport path R1 on the upstream side of the secondary transfer device 30.

Moreover, other than these transport rolls, plural transport rolls 48, which transport the sheets P positioned on these sheet transport paths, are provided on the first sheet transport path R1, the second sheet transport path R2, and the third sheet transport path R3. Meanwhile, each of the first transport rolls 44, the second transport rolls 45, the third transport rolls 46, the fourth transport rolls 47, and the transport rolls 48 are formed of a pair of roll-like members that are rotatably provided and pressed against each other. One roll-like member is rotationally driven, so that each of the transport rolls transports the sheets.

Further, in this embodiment, a regulating member 300 against which the front end portion of a sheet P is abutted is provided between the second transport rolls 45 and the third transport rolls 46. In this embodiment, the front end portion of the sheet P is abutted against the regulating member 300 by the third transport rolls 46 which transports the sheet P toward the regulating member 300, so that the skew of the sheet P (the inclination of the sheet P to the transport direction) is corrected. Meanwhile, the regulating member 300 moves toward the downstream side in the transport direction of the sheet P while the front end portion of the sheet P is abutted against the regulating member 300. Moreover, the regulating member 300 reaches the second transport rolls 45 and moves to the downstream side of the second transport roll 45. Further, in this embodiment, the regulating member 300 reaches the second transport rolls 45, so that the sheet P is delivered to the second transport roll 45 from the regulating member 300.

Figure 2:
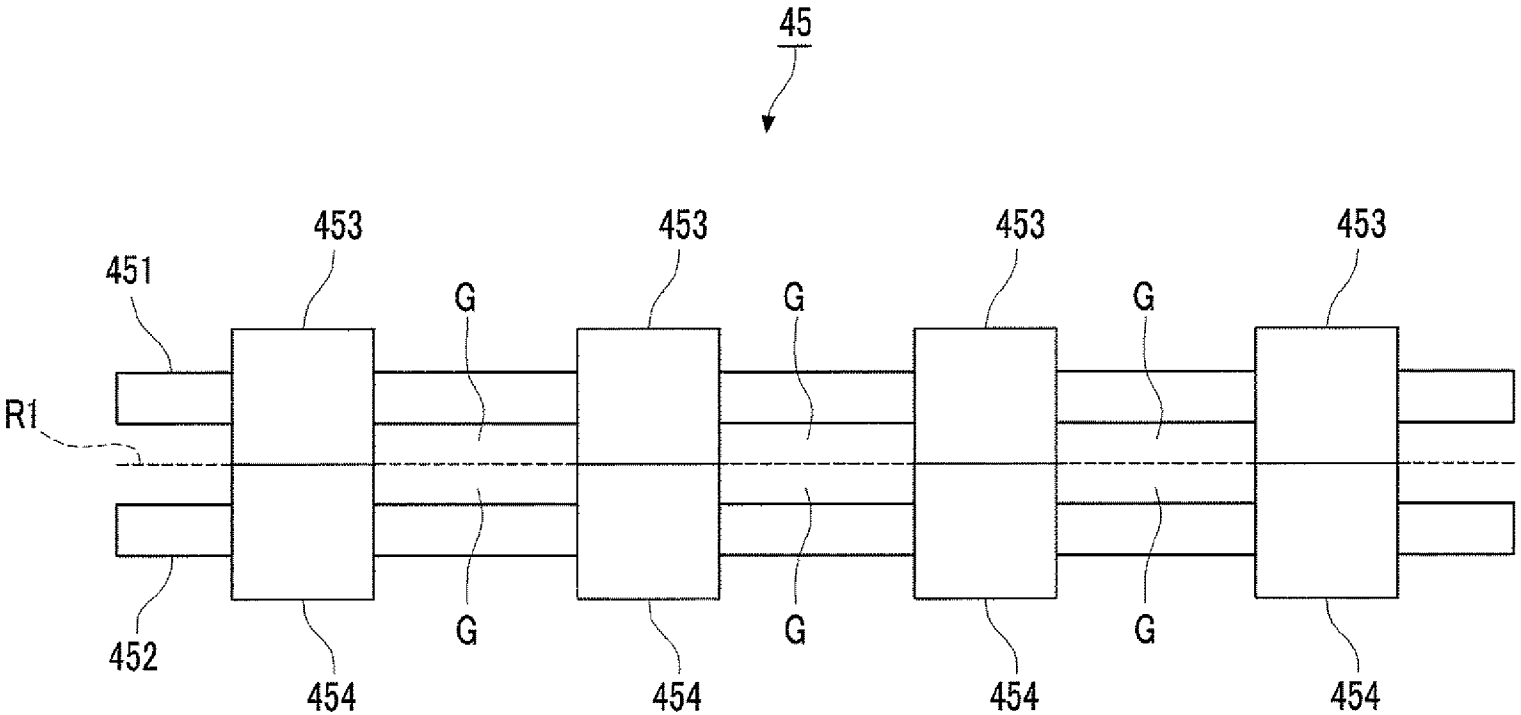
FIG. 2 is a view showing second transport rolls as seen from the upstream side in the transport direction of a sheet.

Meanwhile, as shown in FIG. 2 (which is a view showing the second transport rolls 45 as seen from the upstream side in the transport direction of a sheet P), the second transport rolls 45 include two rotating shafts 451 and 452 that are disposed parallel to each other, roll-like members 453 that are mounted on one rotating shaft 451 and rotate together with the one rotating shaft 451, and roll-like members 454 that are mounted on the other rotating shaft 452 and rotate together with the other rotating shaft 452.

Here, the roll-like members 453 and 454 are disposed so as to come into contact with each other, and plural (plural sets of) roll-like members 453 and 454 are provided at different positions in the axial direction of the second transport roll 45. Further, gaps G are formed between the roll-like members 453 adjacent to each other in the axial direction of the rotating shaft 451 and between the roll-like members 454 adjacent to each other in the axial direction of the rotating shaft 452.

Here, a front end portion of the regulating member 300 of this embodiment, which is positioned close to the first sheet transport path R1, is formed in a comb-teeth shape (not shown). The regulating member 300 includes plural protruding portions (not shown), which protrude over the first sheet transport path R1, at the front end portion. Here, the plural protruding portions are provided so as to be deviated from each other in a direction orthogonal to the transport direction of a sheet P. The front end portion of a sheet P is abutted against these protruding portions, so that the skew of the sheet P is corrected.

Meanwhile, in this embodiment, when the regulating member 300 reaches the second transport rolls 45, the protruding portions move to the downstream side of the second transport roll 45 through the gaps G formed at the second transport rolls 45. Further, when the protruding portions pass through the gaps G, the sheet P abutted against the protruding portions is delivered to the second transport rolls 45 and the transport of the sheet P performed by the second transport rolls 45 begins.

Meanwhile, after the protruding portions move to the downstream side of the second transport roll 45, the regulating member 300 retreats from the first sheet transport path R1. In other words, after the protruding portions move to the downstream side of the second transport roll 45, the regulating member 300 is displaced so that the protruding portions get out of the first sheet transport path R1. After that, the regulating member 300 returns to the upstream side in the transport direction of a sheet P and returns onto the first sheet transport path R1. In other words, the protruding portions are displaced so as to protrude over the first sheet transport path R1. Accordingly, the skew correction of a sheet P, which is newly transported, may be performed.

The image forming apparatus 100 will be further described with reference to FIG. 1 again.

In the image forming apparatus 100 according to this embodiment, a fixing device 50 is provided on the second sheet transport path R2. The fixing device 50 fixes images, which have been secondarily transferred to a sheet P by the secondary transfer device 30, to the sheet P. Here, the fixing device 50 includes a heating roll 50A that is heated by a built-in heater (not shown) and a pressing roll 50B that presses the heating roll 50A. In the fixing device 50, a sheet P is heated and pressed by passing between the heating roll 50A and the pressing roll 50B. Accordingly, images transferred to the sheet P are fixed to the sheet P.

Further, a transporting device 51, which transports the sheet P having passed through the secondary transfer device 30 to the fixing device 50, is provided between the secondary transfer device 30 and the fixing device 50. Here, the transporting device 51 includes a revolving belt 51A, and transports a sheet P while the sheet P is placed on the belt 51A.

Here, each of the image forming units 10 functioning as a part of an image forming section includes a photoreceptor drum 11 that is rotatably mounted. Further, a charging device 12 that charges the photoreceptor drum 11, an exposure device 13 that writes an electrostatic latent image by exposing the photoreceptor drum 11, and a developing device 14 that changes the electrostatic latent image formed on the photoreceptor drum 11 to a visible image are provided around the photoreceptor drum 11. Furthermore, a primary transfer device 15 and a drum cleaning device 16 are provided around the photoreceptor drum 11. The primary transfer device 15 transfers the toner images, which have the respective color components and are formed on the photoreceptor drum 11, to the intermediate transfer belt 20. The drum cleaning device 16 removes toner remaining on the photoreceptor drum 11.

The intermediate transfer belt 20 is stretched by three roll-like members 21 to 23 and provided so as to rotate. Among these roll-like members 21 to 23, the roll-like member 22 is adapted to drive the intermediate transfer belt 20. Further, the roll-like member 23 is disposed so as to face a secondary transfer roller 31 with the intermediate transfer belt 20 interposed therebetween. The secondary transfer roller 31 and the roll-like member 23 form the secondary transfer device 30. Meanwhile, a belt cleaning device 24, which removes toner remaining on the intermediate transfer belt 20, is provided at the position that faces the roll-like member 21 with the intermediate transfer belt 20 interposed therebetween.

Furthermore, in the image forming apparatus 100 according to this embodiment, it is possible to form images on a first surface of a sheet P, which is fed from the first sheet feeding device 410 or the like, and to form images on a second surface of the sheet P. More specifically, in the image forming apparatus 100, a sheet P having passed through the fixing device 50 is inverted by the inverting mechanism 500 and the inverted sheet P is transported to the secondary transfer device 30 again. Further, images are transferred to the second surface of the sheet P by the secondary transfer device 30. After that, the sheet P passes through the fixing device 50 again, and the transferred images are fixed to the sheet P. Accordingly, images are formed not only on the first surface of the sheet P but also on the second surface.

Figure 3:
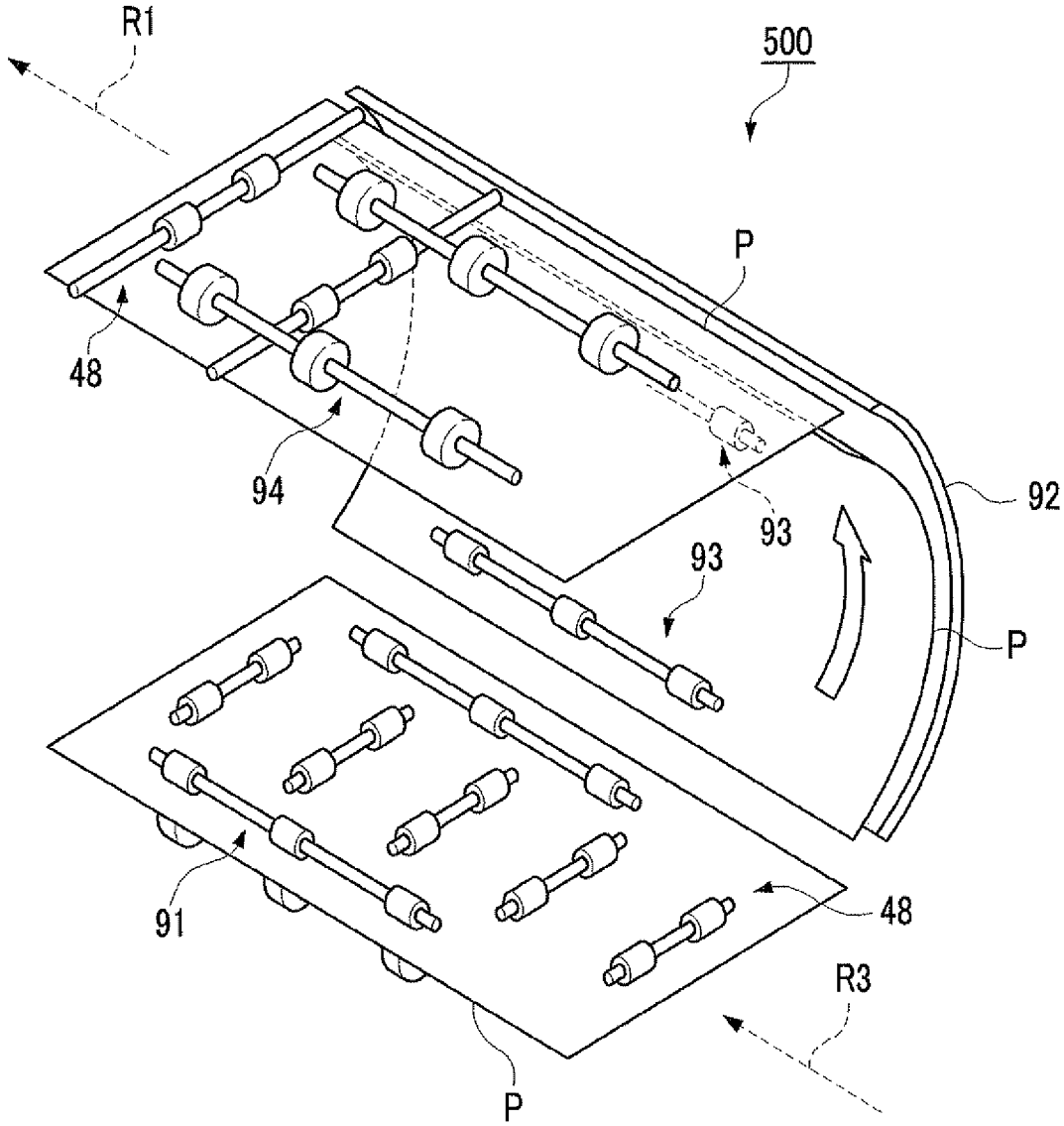
FIG. 3 is a view illustrating an inverting mechanism.

FIG. 3 is a view illustrating the inverting mechanism 500.

As described above, in this embodiment, the plural transport rolls 48, which transport a sheet P along the third sheet transport path R3, are provided on the third sheet transport path R3. Further, the plural transport rolls 48, which transport a sheet P along the first sheet transport path R1, are provided even on the first sheet transport path R1. Furthermore, transport rolls 91, which transport a sheet P in a direction orthogonal to (a direction crossing) the transport direction of the sheet P on the third sheet transport path R3, are provided on the third sheet transport path R3. In other words, transport rolls 91, which transport a sheet P toward the side of the third sheet transport path R3, are provided on the third sheet transport path.

In addition, a guide member 92, which guides a sheet P so that a sheet P transported by the transport rolls 91 moves upward and the sheet P having moved upward further moves toward the first sheet transport path R1, is provided in this embodiment. Moreover, transport rolls 93 are provided in this embodiment. The transport rolls 93 nip a sheet P, which is guided by the guide member 92 and of which the front end portion faces upward, and further transport the sheet P upward. Further, transport rolls 94, which transport the sheet P transported by the transport rolls 93 to a predetermined position on the first sheet transport path R1, are provided on the first sheet transport path R1. Furthermore, although not shown, driving motors (not shown), which drive the transport rolls 48, the transport rolls 91, the transport rolls 93, and the transport rolls 94, are provided in this embodiment. Meanwhile, each of the driving motors is formed of a stepping motor.

Meanwhile, each of the transport rolls 48 are formed of a pair of roll-like members as described above. Further, each of the transport rolls 91, the transport rolls 93, and the transport rolls 94 are formed of a pair of roll-like members that are pressed against each other. Meanwhile, only one roll-like member of each of the pairs of roll-like members of the transport rolls 48, the transport rolls 91, the transport rolls 93, and the transport rolls 94 are shown in FIG. 3.

Moreover, in this embodiment, one roll-like member of the transport rolls 48 is adapted so as to be capable of being separated from the other roll-like member thereof. Further, likewise, one roll-like member of each of the transport rolls 91 and the transport rolls 94 is adapted so as to be capable of being separated from the other roll-like member thereof. Furthermore, although not shown, a separation mechanisms (not shown), which separates one roll-like member of each of these rolls from the other roll-like members thereof, are provided. Meanwhile, each of the separation mechanisms is formed by existing techniques that use a motor, cams, and the like.

When a sheet P is to be inverted by the inverting mechanism 500, first, a sheet P is transported along the third sheet transport path R3 by the transport rolls 48. Meanwhile, at this time, one roll-like member of each of the transport rolls 91 provided on the third sheet transport path R3 is separated from the other roll-like member thereof. Then, one roll-like member of each of the transport rolls 48 is separated from the other roll-like member thereof, and one roll-like member of each of the transport rolls 91 is pressed against the roll-like member thereof with the sheet P interposed therebetween.

After that, the transport rolls 91 and the transport rolls 93 are rotationally driven. Further, the transport rolls 94 are also rotationally driven. Accordingly, the sheet P is transported toward the first sheet transport path R1. Meanwhile, at this time, one roll-like member of each of the transport rolls 48 provided on the first sheet transport path R1 is separated from the other roll-like members thereof. Further, when the sheet P is transported to a predetermined position on the first sheet transport path R1, the rotational drive of the transport rolls 91, the transport rolls 93, and the transport rolls 94 is stopped. Then, one roll-like member of each of the transport rolls 94 is separated from the other roll-like member thereof, and one roll-like member of each of the transport rolls 48 provided on the first sheet transport path R1 is pressed against the roll-like member thereof with the sheet P interposed therebetween.

After that, the transport rolls 48 are rotationally driven, so that the sheet P is transported along the first sheet transport path R1. Meanwhile, at this time, the sheet P has been already inverted. Here, in the inverting mechanism 500 of this embodiment, the front and rear end portions of the sheet P in the transport direction are not reversed and the sheet P is inverted. Meanwhile, in the inverting mechanism 500 of this embodiment, one side and the other side of the sheet are reversed.

Meanwhile, in this embodiment, as described above, the front end portion of a sheet P is abutted against the regulating member 300, so that the skew of the sheet P is corrected. However, in this embodiment, the third transport rolls 46 (see FIG. 1) are also used to perform skew correction. In other words, in this embodiment, second skew correction is performed by the regulating member 300 after first skew correction is performed by the third transport rolls 46. Accordingly, the skew correction of a sheet P is more reliably performed as compared to the structure that performs skew correction once.

The skew correction performed by the third transport rolls 46 will be described below.

Figure 4:
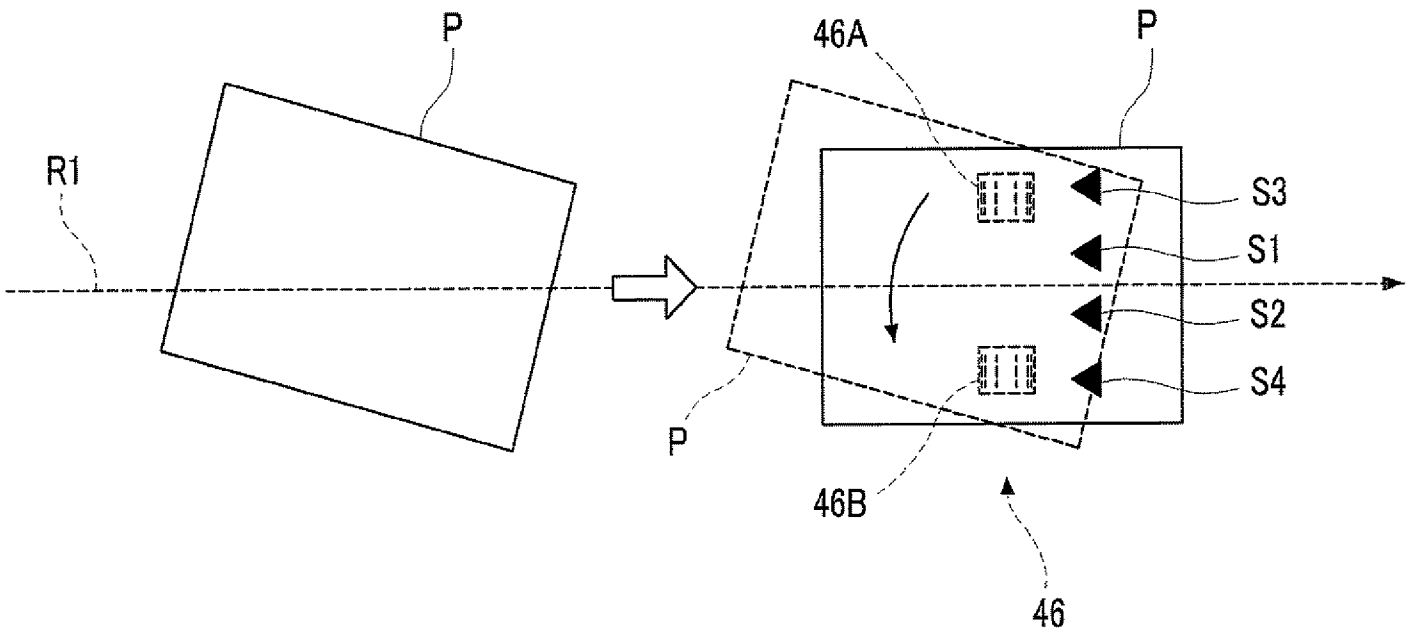
FIG. 4 is a view illustrating the outline of skew correction that is performed by third transport rolls.

FIG. 4 is a view illustrating the outline of the skew correction that is performed by the third transport rolls 46.

Here, the third transport rolls 46 are provided with first and second driving rollers 46A and 46B. The first and second driving rollers 46A and 46B are disposed below a sheet P transported along the first sheet transport path R1, rotate while coming into contact with the sheet P, and move the sheet P to the downstream side. Meanwhile, the first driving roller 46A as an example of a first rotating member is disposed on one side of one side and the other side that face each other with a reference position interposed therebetween. The middle portion of the sheet P (the middle portion of the sheet in the direction orthogonal to the sheet transport direction) is planned to pass through the reference position. Further, the second driving roller 46B as an example of a second rotating member is disposed on the other side of one side and the other side. In detail, the first and second driving rollers 46A and 46B are provided so as to be deviated from each other in the direction orthogonal to (crossing) the transport direction of the sheet P.

Here, when a sheet P is transported while being skewed as shown in FIG. 4, the rotating speed of one driving roller of the first and second driving rollers 46A and 46B is reduced as compared to the rotating speed of the other driving roller (the rotating speed of the first driving roller 46A is reduced in an example shown in FIG. 4). In other words, the rotating speed of the driving roller corresponding to an advanced portion of the sheet P is reduced. Accordingly, a portion of the sheet P, which comes into contact with the driving roller having low rotating speed, (the advanced portion of the sheet P) becomes slower than a portion of the sheet that comes into contact with the driving roller having high rotating speed, so that the skew of the sheet P is reduced. In other words, the sheet P is displaced so that an angle between the side (the side parallel to the transport direction) of the sheet P, which is being transported, and the transport direction of the sheet P is reduced. Accordingly, the skew of the sheet P is reduced.

In detail, in this embodiment, first and second sensors S1 and S2, which detect the front end portion of the transported sheet P, are provided on the downstream side of the first and second driving rollers 46A and 46B in the transport direction of a sheet P. Here, the first and second sensors S1 and S2 are disposed on one line orthogonal to the transport direction of a sheet P. Further, the first and second sensors S1 and S2 are disposed so as to be deviated from each other in a direction orthogonal to the transport direction of a sheet P. Here, each of the first and second sensors S1 and S2 may be formed of, for example, a so-called reflective sensor that includes a light-emitting element and a light-receiving element.

When a sheet P (see a sheet P shown by a broken line) is transported in the state shown in FIG. 4, the front end portion of the sheet P is detected first by the first sensor S1 and the front end portion of the sheet P is then detected by the second sensor S2. Further, in this embodiment, the rotating speed of the first driving roller 46A is reduced by the detection, which is performed by the second sensor S2, as a trigger. After that, the rotating speed of the second driving roller 46B is reduced after the front end portion of the sheet is detected by the second sensor S2 and a predetermined time passes. In detail, the rotating speed of the second driving roller 46B is made equal to the rotating speed of the first driving roller 46A. Accordingly, the skew correction of the sheet P is completed and the sheet P moves toward the regulating member 300 (see FIG. 1) while maintaining a constant attitude.

Meanwhile, in this embodiment, as described above, the rotating speed of the second driving roller 46B is reduced when a predetermined time passes after the front end portion of the sheet is detected by the second sensor S2. This predetermined time is determined on the basis of a time that passes until the front end portion of the sheet is detected by the second sensor S2 after the front end portion of the sheet is detected by the first sensor S1. In other words, the controller 80 determines the above-mentioned predetermined time on the basis of the time difference between the timing when the front end portion of the sheet P is detected by the first sensor S1 and the timing when the front end portion of the sheet P is detected by the second sensor S2.

Here, if the time difference is large, the skew of the sheet P is large and the predetermined time is determined to be long. Further, if the time difference is small, the skew of the sheet P is small and the predetermined time is determined to be short. In detail, since the time difference between the timing when the front end portion of the sheet P is detected by the first sensor S1 and the timing when the front end portion of the sheet P is detected by the second sensor S2 is used in this embodiment, the amount of skew of the sheet P (the amount of the inclination of the sheet P to the sheet transport direction) is detected by the controller 80 as an example of an inclination amount detecting unit. Further, the predetermined time is determined on the basis of the detected amount of the skew.

Meanwhile, a case where the skew of the sheet P is corrected by the reduction of the rotating speed of one driving roller of the first and second driving rollers 46A and 46B has been described in this embodiment. However, the rotating speed of one driving roller corresponding to a lagging portion of the sheet P may be increased, and the rotating speed of the other driving roller may be increased after a predetermined time passes. Meanwhile, in this case, the transport speed of the sheet P is increased after the sheet P passes through the third transport rolls 46.

Meanwhile, in this embodiment, a sheet P is abutted against the regulating member 300 after passing through the third transport rolls 46 (see FIG. 1). Here, if the transport speed of the sheet P is increased as described above after the sheet P passes through the third transport rolls 46, the front end portion of the sheet P is apt to be damaged when the sheet P comes into contact with the regulating member 300. For this reason, in this embodiment, the skew correction of the sheet P is performed by the reduction of the rotating speed of the driving roller without the increase of the rotating speed of the driving roller.

Figure 5:
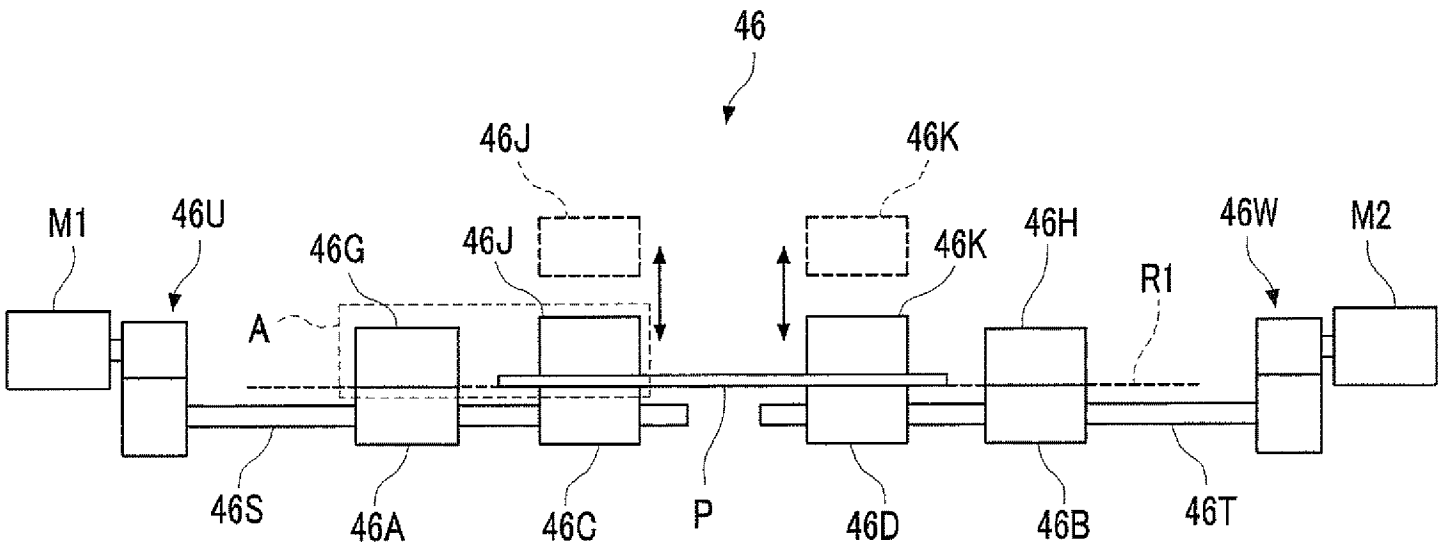
FIG. 5 is a view illustrating the details of the third transport rolls.

FIG. 5 is a view illustrating the details of the third transport rolls 46. In detail, FIG. 5 is a view showing third transport rolls 46 as seen from the upstream side in the transport direction of a sheet P.

The third transport rolls 46 will be further described with reference to FIG. 5. Although not described (shown) in FIG. 4, the third transport rolls 46 are provided with a first shaft 46S. The first shaft 46S is provided along a direction orthogonal to the transport direction of a sheet P, is rotatably provided, and supports the first driving roller 46A. Further, the third transport rolls 46 are provided with a second shaft 46T. The second shaft 46T is provided along the direction orthogonal to the transport direction of the sheet P, is rotatably provided, and supports the second driving roller 46B.

Furthermore, a first motor M1 that rotationally drives the first shaft 46S as an example of a first rotating shaft, a transmission gear train 46U that transmits a drive force from the first motor M1 to the first shaft 46S, a second motor M2 that rotationally drives the second shaft 46T as an example of a second rotating shaft, and a transmission gear train 46W that transmits a drive force from the second motor M2 to the second shaft 46T are provided in this embodiment. In addition, in this embodiment, third and fourth driving rollers 46C and 46D are provided between the first and second driving rollers 46A and 46B. In detail, the third driving roller 46C is provided closer to the first driving roller 46A than the second driving roller 46B, and the fourth driving roller 46D is provided closer to the second driving roller 46B than the first driving roller 46A.

Here, the third driving roller 46C as an example of a third rotating member is supported by the first shaft 46S, and the fourth driving roller 46D as an example of a fourth rotating member is supported by the second shaft 46T. Further, as with the first and second driving rollers 46A and 46B, the third and fourth driving rollers 46C and 46D are provided so as to be deviated from each other in the direction orthogonal to (crossing) the transport direction of the sheet P.

Furthermore, a first contact roll 46G is provided in this embodiment. The first contact roll 46G is provided so as to come into contact with the first driving roller 46A, is rotated by a drive force transmitted from the first driving roller 46A, and moves a sheet P, which is transported to a contact portion between the first driving roller 46A and itself, to the downstream side together with the first driving roller 46A. Moreover, a second contact roll 46H is provided in this embodiment. The second contact roll 46H is provided so as to come into contact with the second driving roller 46B, is rotated by a drive force transmitted from the second driving roller 46B, and moves a sheet P, which is transported to a contact portion between the second driving roller 46B and itself, to the downstream side together with the second driving roller 46B.

Here, although not described above, a sheet P is pressed against the first and second driving rollers 46A and 46B by the first and second contact rolls 46G and 46H when skew correction is performed by the first and second driving rollers 46A and 46B. Accordingly, a slip does not easily occur between the sheet P and the first driving roller 46A and a slip does not easily occur between the sheet P and the second driving roller 46B.

In addition, a third contact roll 46J is provided in this embodiment. The third contact roll 46J is provided so as to come into contact with the third driving roller 46C, is rotated by a drive force transmitted from the third driving roller 46C, and moves a sheet P, which is transported to a contact portion between the third driving roller 46C and itself, to the downstream side together with the third driving roller 46C. Moreover, a fourth contact roll 46K is provided in this embodiment. The fourth contact roll 46K is provided so as to come into contact with the fourth driving roller 46D, is rotated by a drive force transmitted from the fourth driving roller 46D, and moves a sheet P, which is transported to a contact portion between the fourth driving roller 46D and itself, to the downstream side together with the fourth driving roller 46D.

Here, in this embodiment, as described above, skew of a sheet P is corrected by the reduction of the rotating speed of one driving roller of the first and second driving rollers 46A and 46B. Meanwhile, there are sheets having various sizes as the sheet P. When a sheet P has small size, for example, when a sheet P is a "postcard", the sheet P passes between the first and second driving rollers 46A and 46B and the skew of the sheet P may not be corrected. For this reason, in this embodiment, the third and fourth driving rollers 46C and 46D are provided between the first and second driving rollers 46A and 46B so that the skew of the sheet P having a small size is also corrected.

Meanwhile, if the first and second driving rollers 46A and 46B are provided close to each other, the skew of a sheet P having a small size may be corrected even if the third and fourth driving rollers 46C and 46D are not provided. However, if the skew of a sheet P having a large size is corrected in this case, cockles, tracks, or the like are apt to be formed on the sheet P. Further, if the first and second driving rollers 46A and 46B are provided close to each other, accuracy is apt to deteriorate at the time of the skew correction when the skew of a sheet P having a large size is corrected.

For this reason, in this embodiment, the third and fourth driving rollers 46C and 46D are provided between the first and second driving rollers 46A and 46B so that the skew correction of a sheet P having a small size is performed by the third and fourth driving rollers 46C and 46D. Meanwhile, the skew correction performed by the third and fourth driving rollers 46C and 46D is the same as the above-mentioned skew correction performed by the first and second driving rollers 46A and 46B.

In this embodiment, the two first and second sensors S1 and 32 shown in FIG. 4 are disposed close to each other in order to be capable of detecting the front end portion of a sheet P having a small size. Meanwhile, when a distance between the two sensors is large, it is possible to more accurately detect the amount of skew of a sheet P as compared to a case where a distance between the two sensors is small. For this reason, as shown in FIG. 4, the third and fourth sensors S3 and S4 between which the distance is larger than the distance between the first and second sensors S1 and S2 may be provided in addition to the first and second sensors S1 and S2.

Meanwhile, in this case, the amount of skew of a sheet P (a sheet P having a small size) of which the skew is corrected by the third and fourth driving rollers 46C and 46D is detected by the first and second sensors S1 and S2. Further, the amount of skew of a sheet P (a sheet P having a large size) of which the skew is corrected by the first and second driving rollers 46A and 46B is detected by the third and fourth sensors S3 and S4. Meanwhile, the size of a sheet P to be transported is detected by the controller 80 (see FIG. 1) functioning as a size acquisition unit. More specifically, the controller 80 acquires the size of a sheet P on the basis of information that is input through the UI 90 by a user, or information that is sent from a PC (not shown) together with image information.

Meanwhile, when the skew of a sheet P having a large size is to be corrected by the first and second driving rollers 46A and 46B, the rotation (displacement) of the sheet P is restricted if the third driving roller 46C and the third contact roll 46J come into contact with each other and the fourth driving roller 46D and the fourth contact roll 46K come into contact with each other. For this reason, it is difficult to correct the skew of the sheet P. Further, there is a concern that cockles, tracks, or the like are formed on the sheet P.

Accordingly, in this embodiment, the third contact roll 46J as an example of a first contact member is adapted to be capable of approaching and retreating from the third driving roller 46C, so that the third contact roll 46J can be separated from the third driving roller 46C as shown by a broken line of FIG. 5. Further, the fourth contact roll 46K as an example of a second contact member is adapted to be capable of approaching and retreating from the fourth driving roller 46D, so that the fourth contact roll 46K can be separated from the fourth driving roller 46D.

Here, in this embodiment, the approach and retreat of the third and fourth contact rolls 46J and 46K are manually performed by a user (the details will be described below). Meanwhile, a case where the third and fourth contact rolls 46J and 46K are adapted to be movable has been described in this embodiment. However, the third and fourth driving rollers 46C and 46D may be adapted to be movable.

Figure 6:
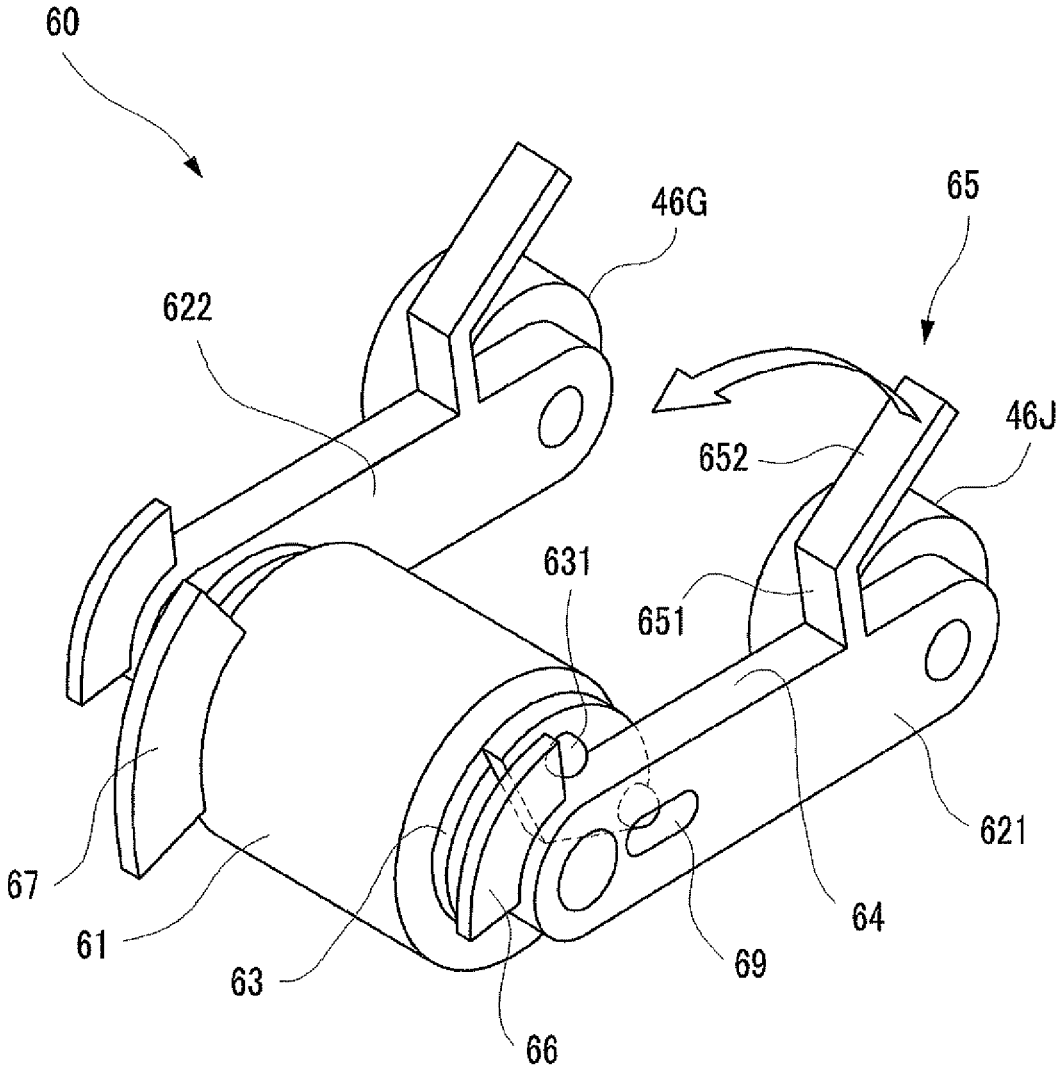
FIG. 6 is an enlarged perspective view of a portion where first and third contact rolls are provided.

FIG. 6 is an enlarged perspective view of a portion where the first and third contact rolls 46G and 46J are provided. In other words, FIG. 6 is an enlarged perspective view of a portion A of FIG. 5. Meanwhile, FIG. 6 shows the portion where the first and third contact rolls 46G and 46J are provided. However, the portion where the second and fourth contact rolls 46H and 46K are provided also has the same configuration as the configuration of the portion where the first and third contact rolls 46G and 46J are provided.

Although not shown in FIG. 5, a support unit 60 supporting the first and third contact rolls 46G and 46J is provided in this embodiment. Meanwhile, the support unit 60 is pushed toward the portion, where the first driving roller 46A (see FIG. 5) and the third driving roller 46C are provided, by a torsion spring (not shown). Further, the first contact roll 46G is pressed against the first driving roller 46A and the third contact roll 46J is pressed against the third driving roller 46D by this pushing.

Here, the support unit 60 includes a gear 61, a shaft (not shown), a first oscillating arm 621, and a second oscillating arm 622. A tooth portion (not shown) is formed on the outer peripheral surface of the gear 61, and the gear 61 is rotated by a drive force transmitted from a driving motor (not shown). The shaft (not shown) is provided so as to pass through the gear 61, is provided at the gear 61 so as to be parallel to the thickness direction, and is fixed to the gear 61. One end of the first oscillating arm 621 is fixed to one end portion of the shaft, and the third contact roll 46J is fixed to the other end of the first oscillating arm. One end of the second oscillating arm 622 is fixed to the other end portion of the shaft, and the first contact roll 46G is fixed to the other end of the second oscillating arm 622.

Moreover, a positioning member 63, which is used to position the first oscillating arm 621, is provided between the first oscillating arm 621 and the gear 61. Here, the positioning member 63 is formed in the shape of a disk, and includes a first protrusion 631 and a second protrusion 632 (which is not shown in FIG. 6 and will be described below) of which end portions are formed in a round shape and which are formed on the surface of the positioning member where the first oscillating arm 621 is provided.

Here, the first oscillating arm 621 has a predetermined thickness and is formed in the shape of a plate. Further, the first oscillating arm 621 includes a protruding portion 65 protruding from a surface 64, which is positioned at the upper portion in FIG. 6, of four side surfaces thereof. The protruding portion 65 protrudes from the side surface 64, and includes a base portion 651 that is disposed perpendicular to the side surface 64. Further, a finger catch 652 is formed at the protruding portion 65. The finger catch 652 is connected to the base portion 651, is disposed so as to cross the base portion 651, is disposed so as to have a gap between the side surface 64 and itself, and catches a user's finger.

Here, when the third contact roll 46J is to be moved by a user in a direction where the third contact roll 46J is separated from the third driving roller 46C (see FIG. 5), the finger catch 652 is pulled upward in FIG. 6 after a user's finger is caught by the finger catch 652. Accordingly, as shown in FIG. 7 (a view showing a state where the third contact roll 46J has moved), the third contact roll 46J is displaced upward and the third contact roll 46J is separated from the third driving roller 46C (see FIG. 5).

Figure 7:
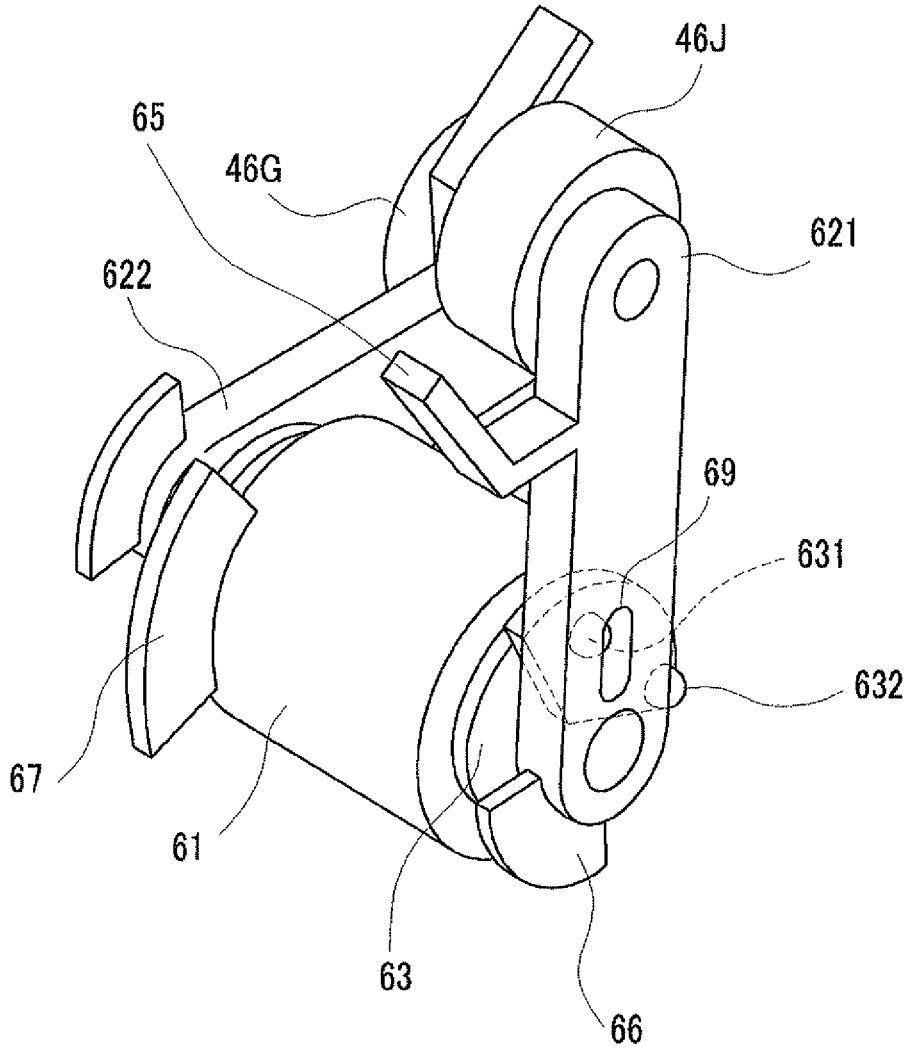
FIG. 7 is a view showing a state where the third contact roll has moved.

Meanwhile, when the first oscillating arm 621 is rotated to a predetermined position, the first protrusion 631 formed on the positioning member 63 enters a through hole 69 formed at the first oscillating arm 621 as shown in FIG. 7. Accordingly, the movement (rotation) of the first oscillating arm 621 is restricted, so that the third contact roll 46J is stayed at a predetermined position. Meanwhile, when the third contact roll 46J is disposed so as to be pressed against the third driving roller 46C, the second protrusion 632 (see FIG. 7) formed on the positioning member 63 enters the through hole 69 of the first oscillating arm 621. Even in this case, the third contact roll 46J is stayed at a predetermined position.

Meanwhile, although not described above, in this embodiment, the nip of a sheet P performed by the third transport rolls 46 is released after the sheet P begins to be transported by the second transport roll 45 (see FIG. 1). Specifically, the first contact roll 46G, the second contact roll 46H, the third contact roll 46J, and the fourth contact roll 46K are separated from the corresponding driving rollers. In this case, the restriction of the rear end portion of a sheet P performed by the third transport rolls 96 is released. Accordingly, the skew of a sheet P or the tension of a sheet P, which is caused by the restriction performed by the third transport rolls 46, is suppressed.

Here, the gear 61 shown in FIG. 6 is rotated in the counterclockwise direction in FIG. 6 by the drive of a motor (not shown), so that the first contact roll 46G, the second contact roll 46H, the third contact roll 46J, and the fourth contact roll 46K are displaced upward. As a result, the first contact roll 46G, the second contact roll 46H, the third contact roll 46J, and the fourth contact roll 46K are separated from the corresponding driving rollers.

Meanwhile, in this embodiment, a protruding piece 67 that protrudes from the outer peripheral surface of the gear 61 and a detection sensor (not shown) that detects the protruding piece 67 are provided in order to detect the states of the first contact roll 46G, the second contact roll 46H, the third contact roll 46J, and the fourth contact roll 46K (in order to detect whether the first contact roll 96G, the second contact roll 46H, the third contact roll 46J, and the fourth contact roll 46K come into contact with the driving rollers).

Meanwhile, when the third and fourth contact rolls 46J and 46K are manually moved as in this embodiment, the third and fourth contact rolls 46J and 46K may come into contact with the corresponding driving rollers despite the transport of a sheet P having a large size. Further, when the third and fourth contact rolls 46J and 46K are manually moved, the third and fourth contact rolls 46J and 46K may not come into contact with the corresponding driving rollers despite the transport of a sheet P having a small size. For this reason, a sensor (not shown) for detecting the positions of the third and fourth contact rolls 46J and 46K and a detection piece 66 to be detected by the sensor are provided in this embodiment as shown in FIGS. 6 and 7.

Here, since the detection piece 66 is formed at the first oscillating arm 621, the positions of the third and fourth contact rolls 46J and 46K are detected by whether or not the detection piece 66 formed at the first oscillating arm 621 is detected by the sensor. Specifically, in this embodiment, the detection piece 66 is detected by the sensor when the third and fourth contact rolls 46J and 46K come into contact with the corresponding driving rollers, and the detection piece 66 is not detected by the sensor when the third and fourth contact rolls 46J and 46K do not come into contact with the corresponding driving rollers.

Here, for example, when the third and fourth contact rolls 46J and 46K come into contact with the corresponding driving rollers despite the transport of a sheet P having a large size, the fact that the third and fourth contact rolls 46J and 46K need to be separated from the corresponding driving rollers may be displayed on the UI 90 (see FIG. 1). In other words, a display for making a user perform an operation for separating the third and fourth contact rolls 46J and 46K from the corresponding driving rollers may be displayed on the UI 90. Meanwhile, in this case, it may be that an image of the finger catch 652 of the first oscillating arm 621 be displayed on the UI 90 and an actual operating position be displayed to a user.

Further, for example, when the third and fourth contact rolls 46J and 46K do not come into contact with the corresponding driving rollers despite the transport of a sheet P having a small size, the fact that the third and fourth contact rolls 46J and 46K need to come into contact with the corresponding driving rollers may be displayed on the UI. In other words, a display for making a user perform an operation for making the third and fourth contact rolls 46J and 46K come into contact with the corresponding driving rollers may be displayed on the UI 90. Meanwhile, even in this case, it may be that an image of the finger catch 652 of the first oscillating arm 621 be displayed on the UI 90 and an actual operating position be displayed to a user.

Meanwhile, the following processing may be performed. For example, when a user makes the third and fourth contact rolls 46J and 46K, which are separated from the corresponding driving rollers, come into contact with the corresponding driving rollers, the display on the UI 90 may be switched to other displays. More specifically, the display on the UI may be switched to the display that is used to receive various conditions, when an image is formed on, for example, a sheet P having a small size, from a user from the display that is used to receive various conditions, when an image is formed on, for example, a sheet P having a large size, from a user.

Further, vice versa, when a user separates the third and fourth contact rolls 46J and 46K from the corresponding driving rollers in the state where the third and fourth contact rolls 46J and 46K come into contact with the corresponding driving rollers, the display on the UI 90 may be switched to other displays. More specifically, the display on the UI may be switched to the display that is used to receive various conditions, when an image is formed on, for example, a sheet P having a large size, from a user from the display that is used to receive various conditions, when an image is formed on, for example, a sheet P having a small size, from a user.

Meanwhile, a case where the third and fourth contact rolls 46J and 46K manually approach and retreat from the driving rollers has been described above. However, the approach and retreat of the third and fourth contact rolls 46J and 46K are not limited to manual approach and retreat, and may be performed by a drive source such as a motor. For example, when the third and fourth contact rolls 46J and 46K come into contact with the corresponding driving rollers despite the transport of a sheet P having a large size, the third and fourth contact rolls 46J and 46K are separated from the corresponding driving rollers by the drive source as an example of a moving unit. Further, an example of the image forming apparatus 100 has been described above. However, the above-mentioned configuration may also be applied to processing devices that perform processing, such as binding, for example, staple binding, punching, and embossing, on sheets P.

Further, it may be that the control of skew correction when the skew of a sheet P having a large size is corrected by the first and second driving rollers 46A and 46B be different from the control of skew correction when the skew of a sheet P having a small size is corrected by the third and fourth driving rollers 46C and 46D. In other words, even when the amount of skew (inclination) of a sheet P having a large size is equal to the amount of skew (inclination) of a sheet P having a small size, it may be that the control of skew correction when skew is corrected by the first and second driving rollers 46A and 46B be different from the control of skew correction when skew is corrected by the third and fourth driving rollers 46C and 46D.

More specifically, when a case where skew correction is performed for a certain unit time by the first and second driving rollers 46A and 46B is compared with a case where skew correction is performed for a certain unit time by the third and fourth driving rollers 46C and 46D, the rotation angle (displacement) of a sheet P, which is rotated (displaced) by the third and fourth driving rollers 46C and 46D, is larger than the rotation angle of a sheet P that is rotated by the first and second driving rollers 46A and 46B.

Further, in this case, even though the skew correction is performed for the same time, the state of the sheet of which the skew has been corrected by the first and second driving rollers 46A and 46B is different from the state of the sheet of which the skew has been corrected by the third and fourth driving rollers 46C and 46D. For this reason, as described above, even though the amount of skew of a sheet P having a large size is equal to the amount of skew of a sheet P having a small size, it may be that the control of skew correction when skew is corrected by the first and second driving rollers 46A and 46B be different from the control of skew correction when skew is corrected by the third and fourth driving rollers 46C and 46D. Specifically, it may be that the time of skew correction performed by the first and second driving rollers 46A and 46B be longer than the time of skew correction performed by the third and fourth driving rollers 46C and 46D.

Meanwhile, a case where the first driving roller 46A, the second driving roller 46B, the third driving roller 46C, and the fourth driving roller 46D are provided parallel to one direction orthogonal to the transport direction of a sheet P has been described above. However, the disposition of the driving rollers is not limited to this disposition, and the first driving roller 46A, the second driving roller 46B, the third driving roller 46C, and the fourth driving roller 46D may be provided so as to be deviated from each other in the transport direction of a sheet P.

Meanwhile, if the first driving roller 46A, the second driving roller 46B, the third driving roller 46C, and the fourth driving roller 46D are provided in one direction, the first and third driving rollers 46A and 46C can be coaxially provided and the second and fourth driving rollers 46B and 46D can be coaxially provided as in this embodiment. Further, in this case, it is possible to reduce the number of drive sources that rotate the first driving roller 46A, the second driving roller 46B, the third driving roller 46C, and the fourth driving roller 46D. In other words, four drive sources do not need to be provided so as to correspond to the first driving roller 46A, the second driving roller 46B, the third driving roller 46C, and the fourth driving roller 46D.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material transporting device comprising:

a transport path along which a recording material is transported;

a first transporting unit that includes a first rotating member and a second rotating member being arranged apart from each other in a direction crossing the transport path, the first transporting unit correcting skew of the recording material by rotating the first rotating member and the second rotating member in a different speed; and a second transporting unit that includes a third rotating member and a fourth rotating member being arranged apart from each other in the crossing direction, the second transporting unit correcting skew of the recording material by rotating the third rotating member and the fourth rotating member in a different speed, wherein the third rotating member and the fourth rotating member are arranged between the first rotating member and the second rotating member, and the first rotating member and the second rotating member containing the recording material during at least a same time.

2. The recording material transporting device according to claim 1, further comprising:

a first contact member that contacts the recording material, the first contact member and the third rotating member nipping the recording material therebetween, and transporting the recording material, which is transported along the transport path, to a downstream in a transporting direction of the recording material; and a second contact member that contacts the recording material, the second contact member and the fourth rotating member nipping the recording material therebetween, and transporting the recording material, which is transported along the transport path, to a downstream in a transporting direction of the recording material, wherein at least one of the third rotating member and the first contact member is movable so that the third rotating member and the first contact member are come in contact with and separate from each other, and at least one of the fourth rotating member and the second contact member is movable so that the fourth rotating member and the second contact member are come in contact with and separate from each other.

3. The recording material transporting device according to claim 2, further comprising:

a first shaft on which the first rotating member and the third rotating member are mounted; and a second shaft on which the second rotating member and the fourth rotating member are mounted, wherein the first shaft rotates the first rotating member and the third rotating member, and the second shaft rotates the second rotating member and the fourth rotating member.

4. The recording material transporting device according to claim 1, further comprising:

a first shaft on which the first rotating member and the third rotating member are mounted; and a second shaft on which the second rotating member and the fourth rotating member are mounted, wherein the first shaft rotates the first rotating member and the third rotating member, and the second shaft rotates the second rotating member and the fourth rotating member.

5. The recording material transporting device according to claim 1, further comprising:

a regulating member is arranged so that an edge of the recording material is abutted against the regulating member while moving toward downstream in a transporting direction of the recording material, wherein the first transport unit and the second transport unit transport the recording material toward the regulating member.

6. An image forming apparatus comprising:

a transport path along which a recording material is transported;

a first transporting unit that includes a first rotating member and a second rotating member being arranged apart from each other in a direction crossing the transport path, the first transporting unit correcting skew of the recording material by rotating the first rotating member and the second rotating member in a different speed;

a second transporting unit that includes a third rotating member and a fourth rotating member being arranged apart from each other in the crossing direction, the second transporting unit correcting skew of the recording material by rotating the third rotating member and the fourth rotating member in a different speed; and an image forming section that forms an image on the recording material transported by the first transport unit and the recording material transported by the second transport unit, the first rotating member and the second rotating member containing the recording material during at least a same time.

7. The recording material transporting device according to claim 6, further comprising:

a first contact member that contacts the recording material, the first contact member and the third rotating member nipping the recording material therebetween, and transporting the recording material, which is transported along the transport path, to a downstream in a transporting direction of the recording material; and a second contact member that contacts the recording material, the second contact member and the fourth rotating member nipping the recording material therebetween, and transporting the recording material, which is transported along the transport path, to a downstream in a transporting direction of the recording material, wherein at least one of the third rotating member and the first contact member is movable so that the third rotating member and the first contact member are come in contact with and separated from each other, and at least one of the fourth rotating member and the second contact member is movable so that the fourth rotating member and the second contact member are come in contact with and separate from each other.

8. The image forming apparatus according to claim 7, further comprising:

a size acquisition unit that acquires the size of the recording material transported along the transport path; and a display unit that displays an instruction image when the size of the recording material acquired by the size acquisition unit is equal to or larger than a predetermined size, the third rotating member contacts with the first contact member, and the fourth rotating member contacts with the second contact member, wherein the instruction image instructs a user to separates the first contact member and the second contact member from the third rotating member and the fourth rotating member.

9. The image forming apparatus according to claim 8, wherein when the first contact member and the second contact member are separated from the corresponding rotating members, the display unit changes an image displayed on the display.

10. The image forming apparatus according to claim 7, further comprising:

a size acquisition unit that acquires the size of the recording material transported along the transport path; and a moving unit that moves the first contact member and the second contact member;

wherein when the size of the recording material acquired by the size acquisition unit is equal to or larger than a predetermined size, the third rotating member contacts with the first contact member, and the fourth rotating member contacts with the second contact member, and the moving unit moves the first contact member and the second contact member to separate from the corresponding rotating members.

11. The image forming apparatus according to claim 6, further comprising:

an inclination detecting unit that detects an amount of inclination of a recording material transported along the transport path, to the transporting direction, wherein the first transporting unit transports the recording material by making the rotating speed of the first rotating member be different from the rotating speed of the second rotating member during a first time when the amount of inclination of the recording material detected by the inclination detecting unit is a first amount, and the second transporting unit transports the recording material by making the rotating speed of the third rotating member be different from the rotating speed of the fourth rotating member during a second time shorter than the first time when the amount of inclination of the recording material detected by the inclination detecting unit is the first amount.

12. The image forming apparatus according to claim 6, further comprising:

a regulating member is arranged so that an edge of the recording material is abutted against the regulating member while moving toward downstream in a transporting direction of the recording material, wherein the first transporting unit and the second transporting unit transport the recording material toward the regulating member.

13. The image forming apparatus according to claim 6, the first rotating member and the second rotating member containing the recording material during at least a same time.

* * * * *